US009200231B2

(12) United States Patent
Shishikura et al.

(10) Patent No.: US 9,200,231 B2
(45) **Date of Patent: *Dec. 1, 2015**

(54) LUBRICATING OIL COMPOSITION FOR ROLLING WITH ROUND DIE

(71) Applicants: IDEMITSU KOSAN CO., LTD., Tokyo (JP); NISSEI CO., LTD., Ohtsuki-shi (JP)

(72) Inventors: Akihiro Shishikura, Ichihara (JP); Toshinaka Shinbutsu, Tokyo (JP); Shuichi Amano, Ohtsuki (JP)

(73) Assignees: IDEMITSU KOSAN CO., LTD., Tokyo (JP); Nissei Co., Ltd., Ohtsuki-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/303,113

(22) Filed: Jun. 12, 2014

(65) Prior Publication Data

US 2014/0296116 A1 Oct. 2, 2014

Related U.S. Application Data

(63) Continuation of application No. 12/934,402, filed as application No. PCT/JP2009/055958 on Mar. 25, 2009, now Pat. No. 8,835,365.

(30) Foreign Application Priority Data

Mar. 28, 2008 (JP) ..... 2008-088244

(51) Int. Cl.

| | |
|---|---|
| ***C10M 141/10*** | (2006.01) |
| ***C10M 129/70*** | (2006.01) |
| ***C10M 135/36*** | (2006.01) |
| ***C10M 133/44*** | (2006.01) |
| ***C10M 137/10*** | (2006.01) |
| ***C10M 169/04*** | (2006.01) |

(52) U.S. Cl.

CPC ..... *C10M 141/10* (2013.01); *C10M 129/70* (2013.01); *C10M 169/04* (2013.01); *C10M 2203/1006* (2013.01); *C10M 2203/1025* (2013.01); *C10M 2207/126* (2013.01); *C10M 2207/127* (2013.01); *C10M 2207/129* (2013.01); *C10M 2207/28* (2013.01); *C10M 2207/282* (2013.01); *C10M 2211/022* (2013.01); *C10M 2215/223* (2013.01); *C10M 2219/046* (2013.01); *C10M 2219/106* (2013.01); *C10M 2223/047* (2013.01); *C10M 2223/049* (2013.01); *C10N 2210/02* (2013.01); *C10N 2220/028* (2013.01); *C10N 2230/02* (2013.01); *C10N 2230/06* (2013.01); *C10N 2230/41* (2013.01); *C10N 2240/02* (2013.01); *C10N 2240/402* (2013.01); *C10N 2240/407* (2013.01)

(58) Field of Classification Search

CPC ..... C10M 141/10; C10M 129/70; C10M 169/04; C10M 2203/1106; C10M 2203/1025; C10M 2207/126; C10M 2207/127; C10M 2207/129; C10M 2207/28; C10M 2207/282; C10M 2211/022; C10M 2215/223; C10M 2219/046; C10M 2219/106; C10M 2223/047; C10M 2223/049; C10N 2210/02; C10N 2220/028; C10N 2230/02; C10N 2230/06; C10N 2230/41; C10N 2240/02; C10N 2240/402; C10N 2240/407

USPC ..... 508/272, 279, 506, 533, 391, 439

See application file for complete search history.

(56) References Cited

U.S. PATENT DOCUMENTS

| | | | | |
|---|---|---|---|---|
| 4,832,860 | A | 5/1989 | Katafuchi et al. | |
| 4,832,867 | A | 5/1989 | Seiki et al. | |
| 5,719,109 | A | 2/1998 | Tokashiki et al. | |
| 6,136,759 | A * | 10/2000 | Takagi et al. | 508/272 |
| 8,835,365 | B2 * | 9/2014 | Shishikura et al. | 508/272 |
| 2004/0204325 | A1 | 10/2004 | Takahashi | |
| 2006/0240998 | A1 | 10/2006 | Sullivan et al. | |
| 2007/0111906 | A1 | 5/2007 | Milner et al. | |
| 2007/0191240 | A1 | 8/2007 | Suda | |
| 2010/0093568 | A1 | 4/2010 | Tagawa et al. | |

FOREIGN PATENT DOCUMENTS

| | | |
|---|---|---|
| JO | 1-225696 | 9/1989 |
| JP | 48-103434 | 12/1973 |
| JP | 62-201994 | 9/1987 |
| JP | 11-349975 | 12/1999 |
| JP | 2001-240884 | 9/2001 |

(Continued)

OTHER PUBLICATIONS

International Search Report in international application No. PCT/JP2009/055958, dated Jun. 16, 2009.

Office Action issued Oct. 22, 2013 in Japanese Patent Application No. 2010-505730.

(Continued)

*Primary Examiner* — James Goloboy

(74) *Attorney, Agent, or Firm* — Oblon, McClelland, Maier & Neustadt, L.L.P.

(57) ABSTRACT

Provided is a lubricating oil composition for round die rolling, which is obtained by blending a base oil with: (A) 0.5 to 40 mass % of a monoester having 13 to 48 carbon atoms (a-1) and/or 0.5 to 30 mass % of a fatty dicarboxylate having 13 to 34 carbon atoms (a-2); (B) 0.01 to 10 mass % of a thiadiazole compound; (C) 0.01 to 15 mass % of a thiophosphite; and (D) 0.01 to 5 mass % of a triazole compound. The lubricating oil composition for round die rolling shows excellent processing performance without using any chlorine-based compound, and is able to improve lubricity in a bearing to lengthen the life of the bearing.

10 Claims, No Drawings

(56) References Cited

FOREIGN PATENT DOCUMENTS

| | | |
|---|---|---|
| JP | 2002-371291 | 12/2002 |
| JP | 2003-138285 | 5/2003 |
| JP | 2003-253284 | 9/2003 |
| WO | 03/097774 | 11/2003 |
| WO | 2005/063947 | 7/2005 |
| WO | 2008/004548 | 1/2008 |
| WO | WO 2008004548 A1 * | 1/2008 |

* cited by examiner

LUBRICATING OIL COMPOSITION FOR ROLLING WITH ROUND DIE

CONTINUING APPLICATION INFORMATION

The present application is a continuation of U.S. application Ser. No. 12/934,402, filed on Jan. 18, 2011, pending, which is a National Stage of International Application No. PCT/JP2009/055958, filed on Mar. 25, 2009.

TECHNICAL FIELD

The present invention relates to a lubricating oil composition for round die rolling.

BACKGROUND ART

Round die rolling is a processing involving: pressing a die as a rolling tool against a material to be processed while rotating the die; and rotating the material to be processed to mold the material. In the processing, an extremely stringent processing such as thread rolling or gear rolling is performed.

Therefore, a lubricating oil to be used in the round die rolling is requested to express such high processing performance as described below under stringent lubricating conditions: tool wear is reduced, and the surface roughness of a processed product is alleviated.

By the way, in the field of a lubricating oil for metal working, a chlorine-based compound such as a chlorinated paraffin or a chlorinated fatty acid ester has been widely used as an effective additive for improving processing performance under stringent conditions. In recent years, however, it has been pointed out that the chlorine-based compound involves such problems as described below in terms of safety to a human body and environmental pollution: the compound has carcinogenicity, and dioxin is produced at the time of the incineration of a waste liquid containing the compound. In view of the foregoing, the use of the chlorine-based compound has been avoided. As a result, the so-called non-chlorine-based lubricating oil blended with no chlorine-based compound has started to be demanded.

Therefore, a lubricating oil to be used in the round die rolling has been requested to show high processing performance without using any chlorine-based compound.

In addition, a bearing for a round die constituted of a nonferrous alloy such as bronze must continue to support a load generated by a processing, so a lubricating oil to be used in the round die rolling is typically adapted to lubricate the bearing as well.

Therefore, a lubricating oil for round die rolling is requested to have the following performance as well as the processing performance: lubricity in the bearing is improved, and the life of the bearing is lengthened.

A cutting oil, a lubricating oil for ordinary rolling, or the like has been conventionally diverted for such a lubricating oil for round die rolling. For example, Patent Documents 1 and 2 each relate to the invention of a cutting oil, and each describe that the cutting oil can be diverted for rolling (see, for example, the paragraph [0157] of Patent Document 1 and the paragraph [0002] of Patent Document 2).

At present, however, the use of a lubricating oil except a lubricating oil for round die rolling such as the cutting oil precludes continuous performance of normal round die rolling because the lubricating oil cannot be provided with the following performance together with the above-mentioned processing performance: lubricity in a bearing is improved, and the life of the bearing is lengthened.

Therefore, a lubricating oil composition for round die rolling which shows excellent processing performance without using any chlorine-based compound, and can improve lubricity in a bearing to lengthen the life of the bearing is expected to appear.

Patent Document 1: JP 2005-272818 A

Patent Document 2: JP 2005-187650 A

DISCLOSURE OF THE INVENTION

Problems to be Solved by the Invention

An object of the present invention is to provide a lubricating oil composition for round die rolling which: shows excellent processing performance without using any chlorine-based compound; and can improve lubricity in a bearing to lengthen the life of the bearing.

Means for Solving the Problems

The inventors of the present invention have found that a composition composed of a combination of specific compounds, the compounds being blended in specific amounts, can achieve the object of the present invention. The present invention has been completed based on such finding.

That is, the present invention provides:

[1] a lubricating oil composition for round die rolling obtained by blending a base oil with (A) 0.5 to 40 mass % of a monoester having 13 to 48 carbon atoms (a-1) and/or 0.5 to 30 mass % of a fatty dicarboxylate having 13 to 34 carbon atoms (a-2), (B) 0.01 to 10 mass % of a thiadiazole compound, (C) 0.01 to 15 mass % of a thiophosphite, and (D) 0.01 to 5 mass % of a triazole compound; and

[2] a lubricating oil composition for round die rolling according to the item [1], in which a dynamic viscosity at 40° C. of the composition is 3 to 80 $mm^2/s$.

Effect of the Invention

According to the present invention, there can be provided a lubricating oil composition for round die rolling which: shows excellent processing performance without using any chlorine-based compound; and can improve lubricity in a bearing to lengthen the life of the bearing.

BEST MODE FOR CARRYING OUT THE INVENTION

The present invention is a lubricating oil composition for round die rolling obtained by blending a base oil with: (A) 0.5 to 40 mass % of a monoester having 13 to 48 carbon atoms (a-1) and/or 0.5 to 30 mass % of a fatty dicarboxylate having 13 to 34 carbon atoms (a-2); (B) 0.01 to 10 mass % of a thiadiazole compound; (C) 0.01 to 15 mass % of a thiophosphite; and (D) 0.01 to 5 mass % of a triazole compound (below, it may be abbreviated simply to a "lubricating oil composition").

The base oil used in the present invention is not particularly limited, and any one of a mineral oil, a grease, and a synthetic oil can be used. Examples of the mineral oil include various mineral oils such as: residual oils each obtained by subjecting a paraffin base crude oil, an intermediate base crude oil, or a naphthene base crude oil to atmospheric distillation, and distillate oils obtained by subjecting the residual oils after the atmospheric distillation to distillation under reduced pressure; and refined oils obtained by refining the residual oils or the distillate oils in accordance with an ordinary method, such as a solvent-refined oil, a hydrocracking-refined oil, a hydrogenation-refined oil, a dewaxed oil, and a clay-treated oil.

In addition, for example, beef tallow, lard, soybean oil, rapeseed oil, rice bran oil, coconut oil, palm oil, palm kernel oil, mutton tallow (lanolin), olive oil, tall oil, castor oil, cottonseed oil, safflower oil, shark liver oil, or a hydrogenated product of any one of them can be used as the grease.

In addition, usable examples of the synthetic oil include: a poly-α-olefin having 8 to 14 carbon atoms, an olefin copolymer (such as an ethylene-propylene copolymer), and a branched olefin such as polybutene or polypropylene, and hydrides of them; ester-based compounds such as a polyol ester (such as a fatty acid ester of trimethylolpropane or a fatty acid ester of pentaerythritol); and an alkylbenzene.

The base oil used in the present invention may be one kind of such mineral oils or a combination of two or more kinds of them, one kind of such greases or a combination of two or more kinds of them, or one kind of such synthetic oils or a combination of two or more kinds of them. Alternatively, a combination of one or more kinds each of two or more kinds of the mineral oil, the grease, and the synthetic oil can also be used.

In addition, the base oil preferably has a dynamic viscosity at a temperature of 40° C. in the range of 2 to 80 $mm^2/s$. The dynamic viscosity is preferably 2 $mm^2/s$ or more because there is no risk of fire due to ignition. Meanwhile, the dynamic viscosity is preferably 80 $mm^2/s$ or less because the amount in which a lubricant is carried out can be reduced. In view of the foregoing, the dynamic viscosity more preferably ranges from 5 to 60 $mm^2/s$.

A monoester having 13 to 48 carbon atoms (a-1) and/or a fatty dicarboxylate having 13 to 34 carbon atoms (a-2) are each/is used as the component (A) in the present invention.

The monoester having 13 to 48 carbon atoms (a-1) is, for example, a compound represented by a general formula (I).

$$RCOOR' \quad (I)$$

In the formula, R represents an alkyl group having 11 to 22 carbon atoms and R' represents an alkyl group having 1 to 25 carbon atoms, and the total number of carbon atoms of R and R' is 12 to 47.

The monoester represented by the general formula (I) preferably has 13 to 36 carbon atoms. Specific examples of the monoester preferably include methyl stearate, butyl stearate, octylstearate, and octyl palmitate. Of those, butyl stearate and octyl palmitate are preferred from the viewpoints of performance and ease of availability.

In the present invention, one kind of such monoesters may be used, or two or more kinds of them may be used in combination. In addition, the loading of the monoester in the lubricating oil composition is selected from the range of 0.5 to 40 mass % with reference to the total amount of the lubricating oil composition. When the loading is less than 0.5 mass %, an improving effect on the processing performance of the lubricating oil composition is not sufficiently exerted in some cases. On the other hand, when the loading exceeds 40 mass %, the extent to which the effect is sophisticated is not large for the loading, so the loading is economically disadvantageous in some cases. In view of the foregoing, the loading of the monoester falls within the range of preferably 3 to 30 mass %, or more preferably 5 to 20 mass %.

The fatty dicarboxylate as the component (a-2) is, for example, a diester as a product of a reaction between a fatty dicarboxylic acid having 12 to 28 carbon atoms, the main skeleton of which is composed of a saturated or unsaturated, branched hydrocarbon chain, and a linear fatty alcohol having 1 to 6 carbon atoms.

When the number of carbon atoms of the fatty dicarboxylic acid is less than 12, the processing performance of the lubricating oil composition deteriorates. On the other hand, when the number exceeds 28, the diester is poor in solubility in the base oil. The number of carbon atoms falls within the range of preferably 14 to 24, or more preferably 16 to 20.

In addition, the fatty dicarboxylic acid preferably has a branched chain as its main skeleton. The presence of the branched chain provides the following advantage: the solubility of the diester in the base oil is improved, so a lubricating oil composition having desired performance can be easily obtained.

The fatty dicarboxylic acid used in the present invention may be saturated or unsaturated; a saturated fatty dicarboxylic acid is more preferable. The saturated fatty dicarboxylic acid is preferably, for example, a compound represented by the following general formula (II).

[Chem 1]

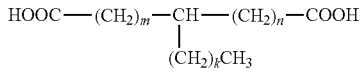

(II)

In the formula, k represents an integer of 0 to 3, m and n each represent an integer of 1 to 23, and the sum of k, m, and n is an integer of 8 to 24.

In the present invention, specific examples of the fatty dicarboxylic acid having 12 to 28 carbon atoms the main skeleton of which is composed of a saturated or unsaturated, branched hydrocarbon chain to be used in the diester as the component (a-2) include compounds represented by the following chemical formulae.

[Chem 2]

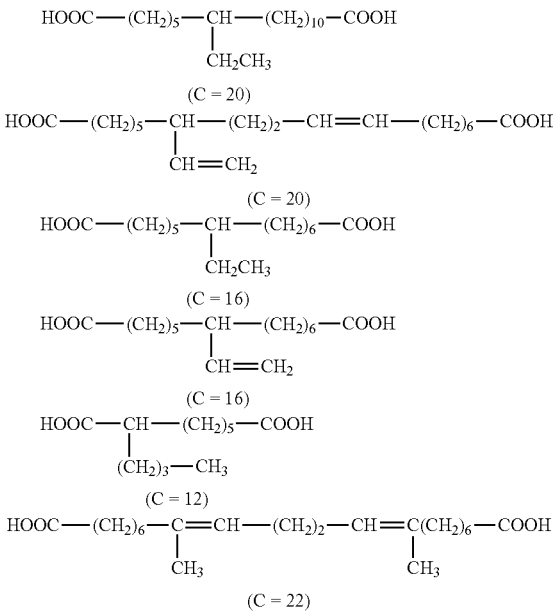

Meanwhile, the fatty alcohol to be used has 1 to 6 carbon atoms. When the number of carbon atoms exceeds 6, the solubility of the diester deteriorates. The number of carbon atoms is preferably 1 to 4. In addition, the fatty alcohol is preferably linear from the viewpoint of the processing performance of the lubricating oil composition.

Specific examples of such linear fatty alcohol include methanol, ethanol, n-propanol, and n-butanol.

In the present invention, a diester obtained from the fatty dicarboxylic acid and the fatty alcohol is used as the component (a-2); one kind of diesters of this type may be used alone, or two or more kinds of them may be used in combination. In addition, the loading of the diester in the lubricating oil composition is selected from the range of 0.5 to 30 mass % with reference to the total amount of the lubricating oil composition. When the content is less than 0.5 mass %, an improving effect on the processing performance of the lubricating oil composition is not sufficiently exerted. On the other hand, when the loading exceeds 30 mass %, the extent to which the effect is sophisticated is not large for the loading, so the loading is economically disadvantageous; in addition, an odor is produced, so a working environment may deteriorate. The content of the diester falls within the range of preferably 1 to 20 mass %, or particularly preferably 1 to 15 mass %.

In the present invention, a thiadiazole-based compound is used as a component (B).

The thiadiazole-based compound to be used herein corresponds to thiadiazole such as 1,4,5-thiadiazole, 1,2,4-thiadiazole, 1,2,5-thiadiazole, and 1,3,4-thiadiazole and derivatives thereof.

The derivatives include a 1,3,4-thiadiazole derivative represented by the following general formula (III), a 1,2,4-thiadiazole derivative represented by the following general formula (IV), and a 1,4,5-thiadiazole derivative represented by the following general formula (V), and 2,5-bis(N,N-dialkyldithiocarbamyl)-1,3,4-thiadiazole represented by the following general formula (VI).

[Chem 3]

(III)

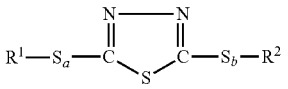

(IV)

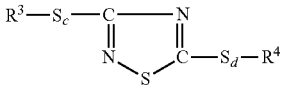

(V)

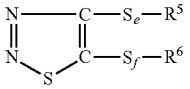

In the formulae (III) to (V), $R^1$ to $R^6$ each represent a hydrogen atom or an alkyl group having 1 to 20, or preferably 1 to 14, carbon atoms, and $R^1$ and $R^2$, $R^3$ and $R^4$, or $R^5$ and $R^6$ may be identical to or different from each other, and a to f each independently represent an integer of 0 to 8, preferably an integer of 1 to 3, or particularly preferably an integer of 1 or 2, and a and b, c and d, or e and f may be identical to or different from each other.

[Chem 4]

(VI)

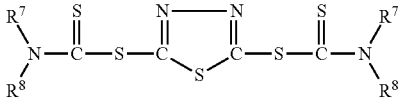

In the formula, $R^7$ and $R^8$ each represent a hydrogen atom or an alkyl group having 1 to 20 carbon atoms, and preferably an alkyl group having 1 to 9 carbon atoms. $R^7$ and $R^8$ may be the same or different from each other.

Specific examples of the alkyl group represented by $R^1$ to $R^6$ in the general formulae (III) to (V) include a methyl group, an ethyl group, an n-propyl group, an isopropyl group, an n-butyl group, an isobutyl group, a sec-butyl group, a tert-butyl group, various pentyl groups, various hexyl groups, various heptyl groups, various octyl groups, various nonyl groups, various decyl groups, various undecyl groups, various dodecyl groups, a tridecyl group, a tetradecyl group, a pentadecyl group, a hexadecyl group, a heptadecyl group, an octadecyl group, a nonadecyl group, and an eicosyl group.

Specific examples of the alkyl group represented by $R^7$ and $R^8$ in the general formula (VI) include a methyl group, an ethyl group, an n-propyl group, an isopropyl group, an n-butyl group, an isobutyl group, a sec-butyl group, a tert-butyl group, various pentyl groups, various hexyl groups, various heptyl groups, various octyl groups, various nonyl groups, various decyl groups, various undecyl groups, and various dodecyl groups.

Specific examples of the thiadiazole derivative include:
alkylthiadiazoles such as
2,5-bis(n-hexyldithio)-1,3,4-thiadiazole,
2,5-bis(n-octyldithio)-1,3,4-thiadiazole,
2,5-bis(n-nonyldithio)-1,3,4-thiadiazole,
2,5-bis(1,1,3,3,-tetramethylbutyldithio)-1,3,4-thiadiazole,
3,5-bis(n-hexyldithio)-1,2,4-thiadiazole,
3,5-bis(n-octyldithio)-1,2,4-thiadiazole,
3,5-bis(n-nonyldithio)-1,2,4-thiadiazole,
3,5-bis(1,1,3,3,-tetramethylbutyldithio)-1,2,4-thiadiazole,
4,5-bis(n-hexyldithio)-1,2,3-thiadiazole,
4,5-bis(n-octyldithio)-1,2,3-thiadiazole,
4,5-bis(n-nonyldithio)-1,2,3-thiadiazole, and
4,5-bis(1,1,3,3,-tetramethylbutyldithio)-1,2,3-thiadiazole; and
dimercaptothiadiazoles such as 2,5-dimercapto-1,3,4-thiadiazole,
3,5-dimercapto-1,2,4-thiadiazole,
3,4-dimercapto-1,2,5-thiadiazole, and
4,5-dimercapto-1,2,3-thiadiazole.

In the present invention, the thiadiazole-based compound is used as the component (B); one kind of such thiadiazole-based compounds may be used alone, or two or more kinds of them may be used in combination. In addition, the loading of the component (B) falls within the range of 0.01 to 10 mass % with reference to the total amount of the lubricating oil composition. When the loading is less than 0.01 mass %, baking may occur at a bearing portion. On the other hand, even when the loading exceeds 10 mass %, the extent to which an improving effect on the processing performance of the lubricating oil composition is sophisticated is not significantly large, so the loading is economically disadvantageous, and moreover, an environment may be deteriorated by an odor. In view of the foregoing, the loading of the component (B) preferably falls within the range of 0.2 to 5 mass %.

In the present invention, a thiophosphite is used as a component (C).

As the thiophosphite to be used herein, there is exemplified a thiophosphite which has a hydrocarbon group having 2 to 30 carbon atoms and preferably a hydrocarbon group having 4 to 20 carbon atoms.

Examples of the hydrocarbon group having 2 to 30 carbon atoms include an alkyl group, a cycloalkyl group, an alkylcycloalkyl group, an alkenyl group, an aryl group, an alkylaryl group, and an arylalkyl group.

Examples of the alkyl group include: an ethyl group; and a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group, each of which may be linear or branched.

Examples of the cycloalkyl group include cycloalkyl groups each having 5 to 7 carbon atoms, such as a cyclopentyl group, a cyclohexyl group, and a cycloheptyl group.

Examples of the alkylcycloalkyl group include alkylcycloalkyl groups each having 6 to 11 carbon atoms, such as a methylcyclopentyl group, a dimethylcyclopentyl group, a methylethylcyclopentyl group, a diethylcyclopentyl group, a methylcyclohexyl group, a dimethylcyclohexyl group, a methylethylcyclohexyl group, a diethylcyclohexyl group, a methylcycloheptyl group, a dimethylcycloheptyl group, a methylethylcycloheptyl group, and a diethylcycloheptyl group.

Examples of the alkenyl group include a butenyl group, a pentenyl group, a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, and an octadecenyl group, each of which may be linear or branched.

Examples of the aryl group include aryl groups such as a phenyl group and a naphthyl group.

Examples of the alkylaryl group include alkylaryl groups each having 7 to 18 carbon atoms, such as a tolyl group, a xylyl group, an ethylphenyl group, a propylphenyl group, a butylphenyl group, a pentylphenyl group, a hexylphenyl group, a heptylphenyl group, an octylphenyl group, a nonylphenyl group, a decylphenyl group, an undecylphenyl group, and a dodecylphenyl group.

Examples of the arylalkyl group include arylalkyl groups each having 7 to 12 carbon atoms, such as a benzyl group, a phenylethyl group, a phenylpropyl group, a phenylbutyl group, a phenylpentyl group, and a phenylhexyl group.

Of those hydrocarbon groups, an alkyl group, an alkenyl group, an aryl group, and an alkylaryl group are preferred from the viewpoints of performance and availability.

Further, examples of the thiophosphite include a thiophosphorous acid monoester, a thiophosphorous acid diester, and a thiophosphorous acid triester. Of those, a thiophosphorous acid triester is more preferred from the viewpoint of performance.

Specific examples of the thiophosphate suitably include monobutylthiophosphite, monolaurylthiophosphite, monooctylthiophosphite, dibutylthiophosphite, dilaurylthiophosphite, dioctylthiophosphite, tributylthiophosphite, trilaurylthiophosphite, trioctylthiophosphite, and triphenylthiophosphite. In particular, tributylthiophosphite, trilaurylthiophosphite, and trioctylthiophosphite are preferred.

In the present invention, the thiophosphite is used as the component (C); one kind of such thiophosphites may be used alone, or two or more kinds of them may be used in combination. In addition, the loading of the component (C) preferably falls within the range of 0.01 to 15 mass % with reference to the total amount of the lubricating oil composition. When the loading is less than 0.1 mass %, an improvement in processing performance of the lubricating oil composition may be insufficient. On the other hand, even when the loading exceeds 15 mass %, the extent to which an improving effect on the processing performance is sophisticated is not expected to be significantly large, so the loading is economically unpreferable; in addition, an odor is produced, so a working environment may deteriorate. The loading of the component (C) more preferably falls within the range of 0.05 to 10 mass %.

In the present invention, a triazole compound is used as the component (D).

For example, benzotriazole represented by the following general formula (VII) and a derivative of benzotriazole each correspond to the triazole compound to be used here. An alkyl benzotriazole represented by the following general formula (VIII), an N-alkyl benzotriazole represented by the following general formula (IX), and an N-(alkyl) aminoalkyl benzotriazole represented by the following general formula (X) are included in the category of the derivative.

[Chem 5]

(III)

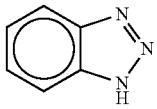

[Chem 6]

(VIII)

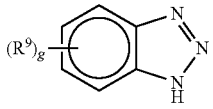

In the formula, $R^9$ represents an alkyl group having 1 to 4 carbon atoms, or preferably an alkyl group having 1 or 2 carbon atoms, and specific examples of the alkyl group include a methyl group, an ethyl group, an n-propyl group, an isopropyl group, an n-butyl group, an isobutyl group, a sec-butyl group, and a tert-butyl group, g represents a number of 1 to 3, or preferably a number of 1 or 2, and, when multiple $R^9$'s are present, the $R^9$'s may be identical to or different from each other.

[Chem 7]

(IX)

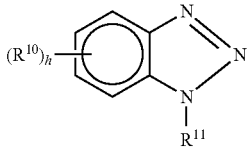

In the formula, $R^{10}$ and $R^{11}$ each represent an alkyl group having 1 to 4 carbon atoms, or preferably an alkyl group having 1 or 2 carbon atoms, and specific examples of such alkyl group are identical to those exemplified for $R^9$, h represents a number of 0 to 3, or preferably a number of 0 or 1, and, when multiple groups represented by $R^{10}$ and $R^{11}$ are present, the groups may be identical to or different from each other.

[Chem 8]

(X)

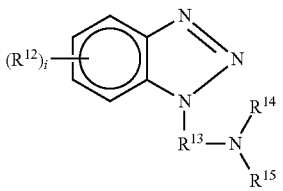

In the formula, $R^{12}$ represents an alkyl group having 1 to 4 carbon atoms, or preferably an alkyl group having 1 or 2 carbon atoms, and specific examples of such alkyl group are identical to those exemplified for $R^1$, $R^{13}$ represents a methylene group or an ethylene group, or particularly preferably a methylene group, $R^{14}$ and $R^{15}$ each independently represent a hydrogen atom or an alkyl group having 1 to 12 carbon atoms, or preferably a hydrogen atom or an alkyl group having 1 to 9 carbon atoms, and specific examples of such alkyl group include a methyl group, an ethyl group, an n-propyl group, an isopropyl group, an n-butyl group, an isobutyl group, a sec-butyl group, a tert-butyl group, various pentyl groups, various hexyl groups, various heptyl groups, various octyl groups, various nonyl groups, various decyl groups, various undecyl groups, and various dodecyl groups, and $R^{14}$ and $R^{15}$ may be identical to or different from each other, and i represents a number of 0 to 3, or preferably a number of 0 or 1.

In the present invention, benzotriazole and N-methyl benzotriazole out of benzotriazole and the derivative of benzotriazole described above are particularly preferable.

In the present invention, the triazole compound is used as the component (D); one kind of such triazole compounds may be used alone, or two or more kinds of them may be used in combination. In addition, the loading of the component (D) falls within the range of 0.001 to 5 mass % with reference to the total amount of the lubricating oil composition. When the loading is less than 0.001 mass %, a lengthening effect on the life of a bearing is not sufficiently exerted in some cases. On the other hand, even when the loading exceeds 5 mass %, the extent to which the effect is sophisticated is not significantly large, so the loading is economically disadvantageous. Therefore, the loading of the component (D) preferably falls within the range of 0.005 to 3 mass %.

The lubricating oil composition of the present invention is obtained by blending the base oil with the above respective components (A) to (D); furthermore, the lubricating oil composition can be blended with any one of the various additives such as a wear-resisting agent, an antioxidant, a corrosion inhibitor, and a defoaming agent as desired to such an extent that the object of the present invention is not impaired.

An example of the wear-resisting agent includes a thiophosphorous acid metal salt such as zinc dialkyldithiophosphate.

Examples of the antioxidant include: phenol-based antioxidants such as 2,6-di-tert-butyl-4-methylphenol and 4,4'-methylenebis(2,6-di-tert-butylphenol); and amine-based antioxidants such as phenyl-α-naphthylamine and 4,4'-dioctyldiphenylamine.

Examples of the rust inhibitor and the corrosion inhibitor include fatty acid, alkenylsuccinic acid half ester, fatty acid soap, alkylsulfonate, aliphatic amine, paraffin oxide, and alkylpolyoxyethylene ether.

Examples of the defoaming agent include dimethylpolysiloxane and polyacrylate.

One kind of those additives may be used alone, or two or more kinds of them may be used as a mixture. In addition, the loading of each of those additives typically falls within the range of 0.0001 to 10 mass % with reference to the composition.

The composition of the present invention preferably has a dynamic viscosity at 40° C. of 3 to 80 $mm^2/s$. When the dynamic viscosity at 40° C. of the composition is 3 $mm^2/s$ or more, the composition expresses good processing performance, and the life of a bearing can be lengthened. In addition, when the dynamic viscosity is 80 $mm^2/s$ or less, the amount of an oil to be carried out by a processing can be suppressed, and the consumption loss of a lubricant can be curtailed.

EXAMPLES

Next, the present invention will be described in more detail by way of examples. However, the present invention is by no means limited by these examples.

Evaluation Methods (1) Falex Wear Test (Test Conditions)

Pin material; AISI3135 (AISI1137)

Block material; CAC702 (ALBC-2) (aluminum bronze)

Number of revolutions; 290 rpm

Oil temperature; 50° C.

(Evaluation Method)

Evaluation was performed by measuring the wear amount (mg) of a block.

(2) SHELL EP Test

The test was performed in conformity with ASTM D 2783, and an extreme pressure characteristic was represented in terms of a welding load (LNL N).

(3) Thread Rolling Test (Testing Device and Test Conditions)

Rolling machine; "A22B" manufactured by Nissei Co., Ltd.

Material for bearing; CAC702 (ALBC-2) (aluminum bronze)

Die; SKD-11 ("DC-53" manufactured by Daido Steel Co., Ltd.)

Material to be processed; S45C and SUS304

Shape of processed part; Hollow screw (M16, pitch 1.5, screw length 15 mm)

Number of revolutions of die; 400 rpm

Method of applying lubricating oil;

Shower

Number of processed parts; 100,000 parts (Evaluation Method)

After the material had been processed into 100,000 parts, the die, the bearing, and each processed part (screw) were evaluated for the following items.

Die wear; Amount in which the diameter of the die reduces (μm)

Presence or absence of baking of bearing;

Visual Observation

State of processed surface of screw;

The external appearance of a screw was visually inspected and evaluated on the basis of the following evaluation criteria. The best case is denoted by 10, and the worst case is denoted by 1.

<Evaluation Criteria for State of Processed Surface>

10: A mirror surface shows no color change.

9: A mirror surface shows a slight color change (color unevenness is present).

8: A mirror surface shows an evident color change (color unevenness is small).

7: The color of a mirror surface changes to a black color (color unevenness is large).

6: Slight peeling occurs at a bottomland.

5: Small peeling occurs at a bottomland.

4: Large peeling occurs at a bottomland.

3: Surface roughening occurs slightly.

2: Surface roughening occurs to a small extent.

1: Surface roughening occurs to a large extent, and a crack is present at the top of a tooth.

Screw accuracy: Screw pitch diameter (mm)

Examples 1 to 7 and Comparative Examples 1 to 7

As shown in Table 1, a lubricating oil composition was obtained by blending a base oil with each additive component, and was evaluated by the above methods. Table 1 shows the results.

TABLE 1

Table 1-1

| | | | Example | | | | | | |
|---|---|---|---|---|---|---|---|---|---|
| | | | 1 | 2 | 3 | 4 | 5 | 6 | 7 |
| Loading (mass %) | Monoester*1 | | 10 | 10 | 15 | 15 | 15 | 5 | 20 |
| | Dibasic acid ester*2 | | 0.5 | 5 | 3 | 3 | 3 | 5 | 4 |
| | Thiadiazole compound*3 | | 0.5 | 1.5 | 3 | 3 | 2 | 3 | 3 |
| | Thiophosphite*4 | | 0.1 | 2 | 5 | 5 | 3 | 3 | 3 |
| | Benzotriazole compound*5 | | 0.01 | 0.2 | 0.3 | 0.3 | 0.1 | 0.5 | 0.1 |
| | Chlorinated paraffin*6 | | — | — | — | — | — | — | — |
| | Ca sulfonate*7 | | — | — | — | — | 3 | 5 | — |
| | Zn-DTP*8 | | — | — | — | — | 2 | 3 | — |
| | Base oil*9 | | 88.89 | 81.3 | 73.7 | 73.7 | 71.9 | 75.5 | 69.9 |
| Property of composition | Dynamic viscosity at 40° C. [$mm^2/s$] | | 3.2 | 16.4 | 36.8 | 36.8 | 48.2 | 63.7 | 79.6 |
| Results of evaluation | FALEX wear test, Wear amount of block [mg] | | 18.3 | 20.8 | 14.6 | 14.6 | 9.7 | 3.2 | 15.4 |
| | SHELL EP test, Welding load [LNL, N] | | 618 | 981 | 981 | 981 | 1,569 | 1,569 | 981 |
| | Thread rolling test | Material to be processed into screw | S45C | S45C | S45C | SUS304 | S45C | S45C | S45C |
| | | Die wear [μm] | 22 | 18 | 10 | 41 | 4 | 5 | 15 |
| | | Presence or absence of baking of bearing | Slightly present | Slightly present | Absent | Absent | Absent | Absent | Absent |
| | | State of processed surface [visual observation, 10-scale evaluation] | 9 | 9 | 10 | 10 | 10 | 10 | 10 |
| | | Screw accuracy [pitch diameter, μm] | 15.971 | 16.008 | 16.011 | 16.010 | 15.998 | 16.004 | 16.009 |

Table 1-2

| | | | Comparative Example | | | | | | |
|---|---|---|---|---|---|---|---|---|---|
| | | | 1*10 | 2 | 3 | 4 | 5 | 6 | 7 |
| Loading (mass %) | Monoester*1 | | — | 20 | 20 | — | 15 | 15 | 15 |
| | Dibasic acid ester*2 | | — | — | — | — | 5 | 5 | 5 |
| | Thiadiazole compound*3 | | — | — | — | 5 | — | 3 | 3 |
| | Thiophosphite*4 | | — | — | — | 2 | 2 | — | 2 |
| | Benzotriazole compound*5 | | — | — | 0.1 | 0.1 | 0.1 | 0.1 | — |
| | Chlorinated paraffin*6 | | 15 | — | — | — | — | — | — |
| | Ca sulfonate*7 | | 5 | 15 | 5 | — | — | — | — |
| | Zn-DTP*8 | | — | 20 | 1 | — | — | — | — |
| | Base oil*9 | | 80 | 45 | 73.9 | 92.9 | 77.9 | 76.9 | 75 |
| Property of composition | Dynamic viscosity at 40° C. [$mm^2/s$] | | 46.7 | 57.3 | 14.8 | 35.4 | 33.8 | 36.1 | 35.7 |
| Results of evaluation | FALEX wear test, Wear amount of block [mg] | | 50.8 | 28.4 | 36.8 | 31.5 | 34.8 | 29.8 | 27.3 |
| | SHELL EP test, Welding load [LNL, N] | | 785 | 981 | 618 | 981 | 618 | 981 | 981 |
| | Thread rolling test | Material to be processed into screw | S45C | S45C | S45C | S45C | S45C | S45C | S45C |
| | | Die wear [μm] | 43 | 29 | 24 | 33 | 56 | 41 | 21 |
| | | Presence or absence of baking of bearing | Present | Slightly present | Present | Present | Slightly present | Slightly present | Present |
| | | State of processed surface [visual observation, 10-scale evaluation] | 6 | 3 | 7 | 8 | 8 | 9 | 10 |
| | | Screw accuracy pitch diameter, μm] | 15.894 | 15.968 | 16.010 | 15.986 | 15.993 | 16.024 | 16.021 |

[Note]

*1Butylstearate (manufactured by NOF CORPORATION)

*2"IPU", 7,12-dimethyl-7,11-octadiene-1,18-dicarboxylic acid dimethyl, manufactured by OKAMURA OIL MILL, LTD.

*3"Dyeroob R-100", sulfur content of 33.5 wt %, 2,5-bis(n-nonyldithio)-1,3,4-thiadiazole, manufactured by DIC Corporation.

*4"JPS-312", trilauryltrithiophosphite, manufactured by Johoku Chemical Co., Ltd.

*5"REOMET 39", n-alkylbenzotriazole, manufactured by Ciba-Geigy K.K.

*6Chlorine content of 45 mass %

*7"Bryton C-500", calcium sulfonate, manufactured by WITCO

*8"OLOA 267" manufactured by Olonite Japan K.K.

*9Paraffin-based mineral oil (manufactured by Idemitsu Kosan Co., Ltd.)

*10Cutting lubricant containing 4.6 mass % of chlorine and 0.6 mass % of calcium As can be seen from Table 1, the composition of the present invention (each of Examples 1 to 7) has good performance in all aspects. Each of those compositions is superior to the lubricating oil composition of Comparative Example 1 blended with a chlorine-based compound in, for example, at least a die wear amount, the baking of a bearing, and the state of a processed surface. In addition, the lubricating oil compositions of Comparative Examples 2 to 7 each have poor performance in at least one aspect, so none of them has enough performance to be used as a lubricating oil composition for round die rolling.

INDUSTRIAL APPLICABILITY

The lubricating oil composition for round die rolling of the present invention shows excellent processing performance without using any chlorine-based compound, and can improve lubricity in a bearing to lengthen the life of the bearing. Therefore, the composition allows one to perform round die rolling as a difficult processing method in a favorable and efficient manner without involving any influence on a human body or any environmental pollution.

The invention claimed is:

1. A lubricating oil composition for round die rolling obtained by blending a base oil with:

(A) 5 to 20 mass % of butyl stearate;

(B) 0.5 to 3 mass % of a thiadiazole compound;

(C) 0.1 to 5 mass % of a thiophosphite;

(D) 0.1 to 0.5 mass % of a triazole compound; and (E) 3 to 5 mass % of calcium sulfonate, wherein the concentrations of (A), (B), (C), (D), and (E) are relative to the lubricating oil composition as a whole.

2. The lubricating oil composition for round die rolling according to claim 1, which has a kinematic viscosity at 40° C. of 3 to 80 $mm^2/s$.

3. The lubricating oil composition for round die rolling according to claim 1, which contains 5 to 15 mass % of (A).

4. The lubricating oil composition for round die rolling according to claim 1, wherein the thiadiazole compound is 1,4,5-thiadiazole, 1,2,4-thiadiazole, 1,2,5-thiadiazole, or 1,3,4-thiadiazole.

5. The lubricating oil composition for round die rolling according to claim 1, wherein the thiadiazole compound is 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis(1,1,3,3,-tetramethylbutyldithio)-1,3,4-thiadiazole, 3,5-bis(n-hexyldithio)-1,2,4-thiadiazole, 3,5-bis(n-octyldithio)-1,2,4-thiadiazole, 3,5-bis(n-nonyldithio)-1,2,4-thiadiazole, 3,5-bis(1,1,3,3,-tetramethylbutyldithio)-1,2,4-thiadiazole, 4,5-bis(n-hexyldithio)-1,2,3-thiadiazole, 4,5-bis(n-octyldithio)-1,2,3-thiadiazole, 4,5-bis(n-nonyldithio)-1,2,3-thiadiazole, and 4,5-bis(1,1,3,3,-tetramethylbutyldithio)-1,2,3-thiadiazole, 2,5-dimercapto-1,3,4-thiadiazole, 3,5-dimercapto-1,2,4-thiadiazole, 3,4-dimercapto-1,2,5-thiadiazole, or 4,5-dimercapto-1,2,3-thiadiazole.

6. The lubricating oil composition for round die rolling according to claim 1, wherein the thiophosphite has a hydrocarbon group having 2 to 30 carbon atoms.

7. The lubricating oil composition for round die rolling according to claim 1, wherein the thiophosphite is monobutylthiophosphite, monolaurylthiophosphite, monooctylthiophosphite, dibutylthiophosphite, dilaurylthiophosphite, dioctylthiophosphite, tributylthiophosphite, trilaurylthiophosphite, trioctylthiophosphite or triphenylthiophosphite.

8. The lubricating oil composition for round die rolling according to claim 1, wherein the thiophosphite is tributylthiophosphite, trilaurylthiophosphite or trioctylthiophosphite.

9. The lubricating oil composition for round die rolling according to claim 1, wherein the base oil is a mineral oil, grease or a synthetic oil.

10. A method of making the lubricating oil composition for round die rolling according to claim 1, comprising combining (A), (B), (C), (D) and (E).

* * * * *